United States Patent [19]

Motzfeldt

[11] 4,314,846

[45] Feb. 9, 1982

[54] METHOD FOR CARBOTHERMIC PRODUCTION OF ALUMINUM

[76] Inventor: Ketil Motzfeldt, Kjemi Lab. K, 7034 Tronheim-NTH, Norway

[21] Appl. No.: 57,308

[22] Filed: Jul. 13, 1979

[51] Int. Cl.[3] ..... C22D 7/02

[52] U.S. Cl. ..... 75/10 R; 75/68 A

[58] Field of Search ..... 75/68 A, 68 R, 10 R

[56] References Cited

U.S. PATENT DOCUMENTS 2,978,315 4/1961 Schenck et al. ..... 75/10 R

*Primary Examiner*—M. J. Andrews

[57] ABSTRACT

A method for production of aluminum and aluminum alloys by carbothermic reduction of alumina alone or in its mixtures with other oxides, comprising the steps of supplying the reducing agent carbon, and the oxide which shall be reduced, along separate paths so that the carbon is supplied by ascending motion, bringing the carbon and the oxide to meet in a zone to which electrical energy is supplied by electrodes, thereby maintaining a high temperature in this zone and effecting the reaction between carbon and oxide, forcing the reaction gas downwards through the ascending carbon charge, thereby cooling the gas and effecting the condensation of metal vapors, liquid metal running down through the carbon charge and being collected in a receptacle located underneath the carbon charge.

An arrangement for execution of the said method, comprising a vertical shaft inside which the carbon charge contained in carbon containers moves upwards and meets the oxide charged from above, electrical energy being supplied by electrodes extending through the oxide charge, and underneath the shaft an elongated chamber furnished with two sets of vertical columns and hoisting machinery for supporting and moving the carbon containers through the shaft, the two sets mounted on a common carriage which can be displaced horizontally so that the two columns alternate in the working position directly underneath the shaft.

5 Claims, 3 Drawing Figures

METHOD FOR CARBOTHERMIC PRODUCTION OF ALUMINUM

FIELD OF THE INVENTION

Figure 1:
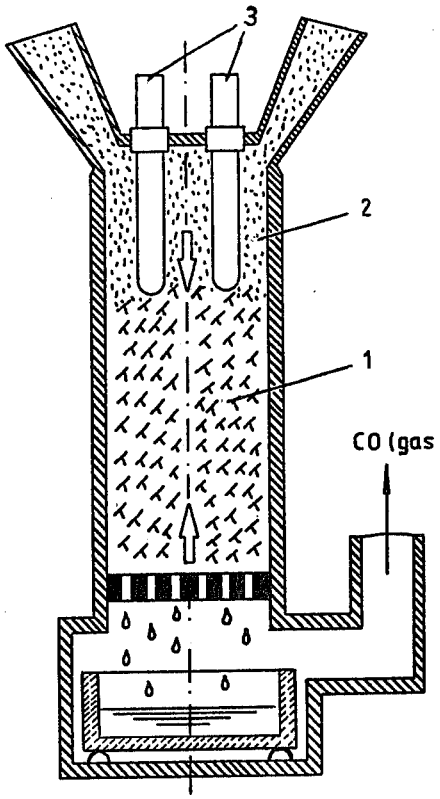

The present invention relates to the production of aluminum by carbothermic reduction of alumina, including the production of aluminum in its alloys with other metals (such as silicon) by reduction of alumina in its mixtures with other oxides (such as silica).

DESCRIPTION OF PRIOR ART

It has been known for at least twenty years that aluminum may be produced by carbothermic reduction of alumina, e.g., in a submerged-arc electric furnace. The scientific principles involved in the chemistry and thermodynamics of the reactions are now fairly well understood (C. N. Cochran, Metal-Slag-Gas Reactions and Processes, Electrochem. Soc., Princeton, N.J. 1975, pp. 299–316; K. Motzfeldt and B. Sandberg, Light Metals 1979, A I M E, New York, N.Y. 1979, Vol. 1 pp. 411–428, and references cited therein).Nonetheless, no commercial process based on these principles has been established.

It is known that the reduction of alumina by carbon, when carried out under reduced pressure, proceeds with aluminum oxycarbide and aluminum carbide as intermediate products:

$$2Al_2O_3+3C=Al_4O_4C+2CO(g) \quad (1)$$

$$Al_4O_4C+6C=Al_4C_3+4CO(g) \quad (2)$$

Below 1900° C., all reactants and products except CO are solids. In order to attain an equilibrium gas pressure of 1 atm, however, temperatures of around 2000° C. are required, the reaction mixture will be partially molten, and the simple equations (1) and (2) are no longer directly applicable. Likewise, the final, metal-producing step might be written $$Al_4O_4C+Al_4C_3=8Al(l)+4CO(g) \quad (3)$$

The calculated equilibrium gas pressure for this reaction reaches 1 atm at about 2100° C. In a reduction furnace operated under atmospheric pressure, the reaction zone must be maintained at a temperature at least sufficient to give the equilibrium pressure of CO equal to 1 atm. Allowing for some over-pressure to drive the reaction, this means in the present case a temperature of about 2150° C. At this temperature the system will consist of solid carbon plus two liquids, that is, an oxide-carbide melt and a metallic melt. Eqn. (3) is not applicable, and the metal-producing reaction may schematically be written $$(\text{oxide-carbide melt})+C(s)=(\text{metal melt})+CO(g) \quad (4)$$

Concurrent with the production of carbon monoxide and condensed products, volatile aluminum-bearing species $Al_2O(g)$ and $Al(g)$ will also be formed. In the first steps of the reaction, formally described by eqn.s (1) and (2), the equilibrium pressures of $Al_2O$ and Al amount to only a few percent of the equilibrium pressure of CO. In the final step, represented by eqn.s (3) or (4), the proportions of $Al_2O$ and Al in the equilibrium gas are higher, but not excessive. It has been shown, however (K. Motzfeldt and M. Steinmo, Proc. 3 Nordic High Temp. Symposium, Polyteknisk Forlag, Copenhagen 1973, Vol. 2 pp. 91–109) that the reaction between alumina and carbon proceeds via a mechanism involving a gas phase with a high proportion of $Al_2O$ and Al; as a consequence the losses by volatilization will be higher than those expected from the equilibria. Furthermore the metallic melt has a lower density than that of the oxide-carbide melt and thus floats on top of the latter. The CO gas evolved by reaction (4) must pass through the metal melt, which further enhances losses by volatilization.

It should be noted that volatilization of Al and $Al_2O$ from the hot zone does not necessarily lead to metal loss. In a submerged-arc furnace the reaction gas passes upwards through layers of colder charge, where the metal-bearing vapors may condense, at the same time preheating the charge. With a high fraction of metal vapors in the gas, however, the carge runs too hot, and losses by volatilization do occur.

A further difficulty in the carbothermic production of aluminum is caused by the substantial solubility of carbon in the metal at reaction temperature, about 20 atom % C when the metallic melt is in equilibrium with solid carbon. When the melt is cooled, this carbon precipitates as aluminum carbide. From the equation $$(12Al+3C,\ \text{molten mixture})=Al_4C_3(s)+8Al(l) \quad (5)$$

it is seen that about one-third of the metal value is precipitated as carbide. This necessitates a subsequent separation step, and recycling of the aluminum carbide, which is a disadvantage to the economy of the process.

Another difficulty in the carbothermic reduction of alumina in a submerged-arc furnace relates to the energy input and heat transfer. As explained above, the metallic melt floats on top and will be directly underneath the electrodes. Because of the high electrical conductivity of the metal, the resistance in the furnace circuit will be low, and difficulties are experienced in maintaining an adequate energy input to the furnace. Furthermore, the heat generation will predominantly take place on the surface of the metal, leading to very high metal temperature and substantial evaporation. To the extent this metal is condensed in the charge above the melt, it runs right back into the hot zone and is re-evaporated. The net result of this cyclic process of vaporization and condensation is that a large fraction of the generated heat is transferred upwards in the furnace, instead of being conducted downwards to the oxide-carbide melt where the heat is needed for the endothermic reaction (4).

From thermodynamic considerations one may conclude that the reduction of a mixture of alumina and silica to produce an aluminum-silicon alloy should be more favourable than the reduction of alumina alone as regards reaction temperature and vapor losses, principally because of the mutual lowering of the activities of aluminum and silicon in their liquid alloy. The density of silicon, however, is even lower than that of aluminum, and the difficulties caused by the supernatant metal layer will prevail also in this case.

PRINCIPLES OF THE INVENTION

The difficulties experienced in the reduction of alumina in a conventional submerged-arc furnace and described above are circumvented by the method of the present invention, characterized by the following features:

The carbon (coke) necessary for the reduction is supplied to the reaction zone along a path which is separate from that of the oxide to be reduced.

The said carbon is supplied, continuously or intermittently, by ascending movement, vertically or at an upward angle.

The gas produced by the reactions is transmitted downwards through said carbon.

Figure 2:
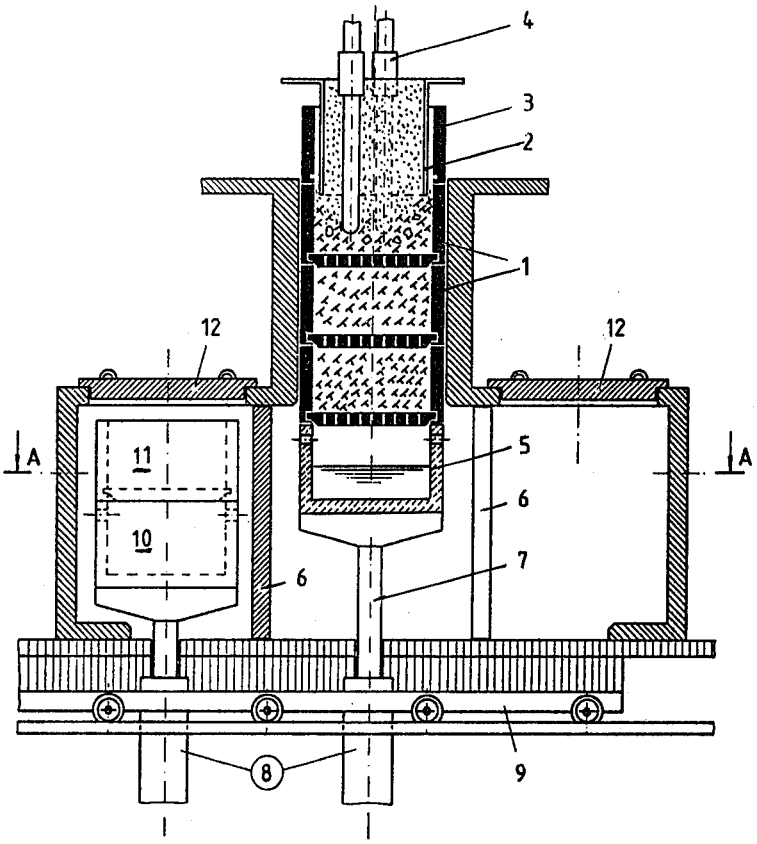
Figure 3:
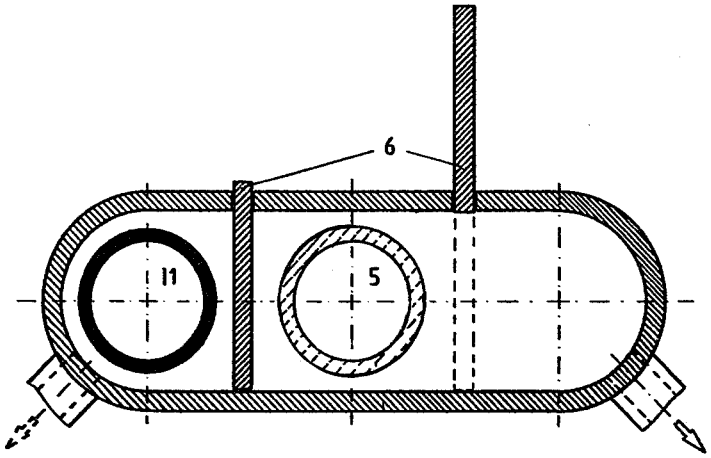

The invention is further described with reference to the accompanying drawings wherein:

FIG. 1 is a shematic drawing exhibiting the essential features of the method, FIG. 2 shows a vertical section through a preferred embodiment of the invention, FIG. 3 is an elevated view of the section A—A as indicated in FIG. 2.

The method according to the present invention will be elucidated with reference to FIG. 1. The reducing agent, in the form of metallurgical coke (1), is supplied from below, with an upward movement as indicated by the lower arrow. The oxide (2) is supplied from above, and will move downwards by gravity as the reaction proceeds. The upper part of the structure shall be essentially gas-tight. Energy is supplied through the electrodes (3). The interspace between the electrodes is filled with electrically insulating oxide, and heat generation takes place only at the lower tip of the electrodes and in the adjacent coke. The intense heat generation in this zone leads to melting of the oxide and immediate reaction with the carbon. The primary product is a gas with high contents of Al and $Al_2O$ vapors in addition to CO. This gas is forced to flow downwards through the carbon or coke charge, and is thereby gradually cooled. Aluminum vapor will then condense to liquid aluminum, while aluminum suboxide will react with the carbon to give liquid aluminum and carbon monoxide.

In the reaction zone, liquid oxide-carbide and liquid metal may also be formed directly. The melting points of these two phases, however, are very different. The oxide-carbide phase will solidify and be retained in the carbon charge at a short distance below the reaction zone, while the liquid metal will continue downwards.

The liquid metal as first formed at high temperature contains dissolved carbon. Running down through the carbon charge, the metal is gradually cooled, whereby solid aluminum carbide precipitates and adheres to the surface of the carbon. At the lower end of the carbon charge the temperature shall be maintained below 1000° C.; at this temperature the solubility of carbon in liquid aluminum is practically nil, and the metal drained from the lower end is essentially free of carbon.

During the gradual cooling of gas and liquid metal through the carbon charge, various back-reactions may also occur to some extent, such as the reaction between liquid metal and carbon monoxide gas, represented by Eqn. (3) from right to left, and the reaction between liquid aluminum and solid carbon to give solid aluminum carbide. It has been demonstrated experimentally, however, that the rates of both of these reactions are low at the temperatures in question. Furthermore the products of these reactions are solids which will be retained in the carbon charge.

The method may be said to be based on the low melting point of aluminium (660° C.). With temperatures below 1000° C. at the lower end of the carbon charge, aluminum is the only remaining liquid in the system. All other reaction products are solids which are retained by the carbon charge, and these solids are brought back into the reaction zone by the upward movement of the carbon. The method is equally suitable for the production of low-melting alloys of aluminum by reduction of the corresponding oxides, such as, e.g. aluminum-silicon alloys with up to 40 weight percent Si (melting point at this composition 950° C.).

A marked advantage of the method is that liquid metal, to the extent it is formed in the hottest reaction zone, is immediately drained from the vicinity of the electrodes. Thus the build-up of a pool of molten metal is prevented, and the heat generation takes place in the arcs between the electrodes and the top layer of carbon and in the oxide—carbon mixture where heat is needed for the reaction.

For a further elucidation of the method, calculations are given to show the energy requirements and the energy distribution through the carbon charge. The calculations are presented for the reduction of pure alumina. As energy expenditures are counted the energy required for heating of the alumina from room temperature to the melting point, the heat of melting of alumina, the further heating to reaction temperature, and the heat of reaction. The heating of the carbon is not counted as an energy expenditure since it will be heated by the countercurrent flow of reaction gas. The cooling of the gas is considered down to 1100 K (827° C.) which is a suitable temperature when the aluminum shall remain liquid.

From the above discussion it will be apparent that it is not possible to tell how large a fraction of the aluminum metal is formed directly as liquid metal, and what fraction is initially formed as aluminum vapor with subsequent condensation in the carbon charge. This is primarily dependent on the kinetics of the reactions and is not amenable to quantitative calculation at the present state of knowledge. The energy calculations are therefore given separately for the two limiting cases: All metal produced directly as liquid, and all metal produced initially as vapor. The thermodynamic data are taken from the JANAF Thermochemical Tables (Natl. Bur. Stand., Washington 1971), with temperatures given in Kelvin (K). The results of the calculations are shown on the next page.

| Alternative I: All metal formed as liquid Al at 2400K | | | | |
|---|---|---|---|---|
| $Al_2O_3$: | Heating 298 - 2327 K | | 61.1 | kcal/mol |
| | Melting at 2327 K | | 28.3 | |
| | Heating 2327 - 2400 K | | 2.5 | |
| $Al_2O_3(1) + 3\ C(s) = 2\ Al(1) + 3\ CO(g)$ | | | 282.2 | |
| Primary energy requirement | | | 374.1 | kcal/2 mol Al |
| | | = | 8.05 | kWh/kg Al |
| Cooling | 2 Al(1) 2400 - 1100 K | | 19.7 | kcal |
| | 3 CO(g)2400 - 1100 K | | 33.2 | |
| | | | 52.9 | kcal |
| Heating 3 C(s) 298 - 2400 K | | | 32.4 | |
| "Excess heat" in the carbon charge | | | 20.5 | kcal/2 mol Al |
| | | = | 0.44 | kWh/kg Al |

| Alternative II: All metal formed as Al vapor at 2600 K | | | | |
|---|---|---|---|---|
| $Al_2O_3$: | Heating 298 - 2327 K | | 61.1 | kcal/mol |
| | Melting at 2327 K | | 28.3 | |
| | Heating 2327 - 2600 K | | 9.5 | |
| $Al_2O_3(1) + 3\ C(s) = 2\ Al(g) + 3\ CO(g)$ | | | 419.6 | |
| Primary energy requirement | | | 518.5 | kcal/2 mol Al |
| | | = | 11.16 | kWh/kg Al |

-continued

| Alternative II: All metal formed as Al vapor at 2600 K | | |
|---|---|---|
| Condensation 2 Al, 2600 K | 139.9 | kcal |
| Cooling 2 Al(1) 2600 - 1100 K | 22.8 | |
| 3 CO(g) 2600 - 1100 K | 38.5 | |
| | 201.2 | kcal |
| Heating 3 C(s) 298 - 2600 K | 36.0 | |
| "Excess heat" in the carbon charge | 165.2 | kcal/2 mol Al |
| | = 3.55 | kWh/kg Al |

It is noted that reactants and products are the same for both alternatives. As a consequence, the net energy requirement, equal to the primary energy requirement minus the excess heat, must be the same regardless of the assumed reaction mechanism and reaction temperature:

| | Alt. I | Alt. II |
|---|---|---|
| Primary energy requirement | 8.05 | 11.16 kWh/kg Al |
| Excess heat | 0.44 | 3.55 |
| Net energy requirement | 7.61 | 7.61 kWh/kg Al |

The excess heat has to be removed in order to maintain the temperature below about 1000° C. in the lower part of the carbon charge. In part this will occur by natural heat loss through the walls of the shaft, in part it may be effected by forced air cooling or by water cooling. In the latter case part of the heat may be reclaimed for auxiliary heating purposes.

In the consideration of the energy economy of the process one also has to take account of the chemical energy of the carbon monoxide. For each kg Al, 1.36 $m^3$ CO gas (1 atm, 25° C.) is produced, with a heat of combustion of 4.35 kWh. Assuming 70 percent efficiency in the utilization of this heat, 3.0 kWh/kg Al has to be detracted from the energy expenditures. On the other hand, heat losses occur by conduction through the furnace walls and the electrodes, but, everything considered, the energy requirements of the process compare favourably with those of the presently used electrolytic process which lie in the range 14 to 17 kWh/kg Al.

PREFERRED EMBODIMENTS

The main technical problem in the method of the invention is the provision of an ascending movement of the carbon charge countercurrent to reaction gas and liquid metal. In FIG. 2 is shown an arrangement in which this problem is solved, while FIG. 3 shows a horizontal section of the same arrangement. In FIG. 2, 1 represents containers of carbonaceous material, charged with coke. The bottom of the containers shall admit the passage of gas and molten metal while retaining the coke. For this purpose the bottom is designed as a grid built from beams of carbon material. As the containers move upwards and the coke charge is consumed, the bottom of the uppermost container will reach the reaction zone, and the carbon material from which it is made will participate as reducing agent in the reaction. 2 is a steel cylinder which acts as a container and guide for the oxide, which is charged from above. 3 represents the walls of the carbon container after the bottom has been consumed by the reaction, these are detached and may be assembled for reuse with a new bottom, or they may be crushed and used as reducing agent. 4 are the electrodes (3-phase). 5 is a container of refractory material suitable for the containment of liquid metal, supported by the column 7 which may be raised or lowered by the hydraulic cylinder 8. The column 7, and hence the pile of carbon containers, are fed upwards at a rate corresponding to the rate of carbon consumption by the reaction, until the bottom of the lower carbon container is about level with the roof of the lower, enlarged part of the reactor chamber. The carbon container is then locked in this position by a mechanical device (not shown in the drawing), and the column 7 with the metal container 5 is lowered. At the same time the left one of the two gates 6 is opened, and the carriage 9 carrying the two hydraulic cylinders 8 is shifted to the right until the empty metal container 10 and the carbon container 11 with coke charge are located directly below the carbon containers in the shaft. The containers 10 plus 11 are then fed upwards until they carry the above pile of carbon containers, and the feeding continues at the rate proper to the reaction. The right-hand gate 6 is now closed so that the reaction gas is forced through the left-hand exhaust port shown in FIG. 2. The right-hand cover 12 is removed, the metal container drained by application of vacuum in a known manner, another carbon container with coke charge placed on top of it, the containers are lowered, the cover replaced, and the assembly is ready for the next shift which takes place in the opposite direction. The time of transfer, from the lowering of one metal container to replacement by the next, will be short compared to the time for consumption of the contents of a carbon container, so that the process may be considered as practically continuous.

The upper side of the carriage 9 is protected by layers of refractory and thermally insulating bricks, as are also the walls of the chamber. A labyrinth lock is arranged between moving and stationary brickwork as known from commercial tunnel ovens. The carriage 9 moves within a gas-tight enclosure to prevent escape of the carbon monoxide gas through the labyrinth lock.

The arrangement shown in FIGS. 2 and 3 is based on a vertical movement of the carbon charge and should be considered as an example which does not impose limitations on the method of the invention; the movement of the carbon charge may alternatively be arranged at an angle below the reaction chamber or tangentially to it, although these forms of the apparatus are not shown here.

What is claimed is:

1. A method of producing aluminium and aluminum alloys by carbothermically reducing an oxide selected from the group consisting of alumina and alumina-containing oxide admixtures which comprises:

(a) supplying carbonaceous material and said oxide separately along mutually coverging paths and (b) exposing said carbonaceous material and said oxide to a predetermined high temperature by supplying electrical heat energy to a reaction zone located at a position where said paths meet thereby to effect said carbonaceous reduction of said oxide, said carbonaceous material proceeding along its path to said reaction zone by an ascending movement adapted to the rate of consumption of said material in said zone and being supported in containers made of similar material, said containers being moved substantially vertically to be at least partially and progressively consumed along with said carbonaceous material on reducing said oxide in said zone.

2. The method of claim 1, wherein the bottom of each of said carbon containers has the form of a grid built from beams of carbonaceous material.

3. A method producing aluminium and aluminium alloys by carbothermically reducing an oxide selected from the group consisting of alumina and alumina-containing oxide admixtures which comprises:

(a) supplying carbonaceous material with an upward movement from below a reaction zone and said oxide separately from above said reaction zone along mutually converging paths and (b) exposing said carbonaceous material and said oxide to a predetermined high temperature by supplying electrical heat energy to said reaction zone located at a position where said paths meet thereby to effect said carbothermic reduction of said oxide.

4. The method of claim 3, wherein said carbonaceous material is supported in containers made of similar material, said containers being moved substantially vertically to be at least partially and progressively consumed along with said carbonaceous material on reducing said oxide in said zone.

5. The method of claim 4, wherein the bottom of each of said carbon containers has the form of a grid built from beams of carbonaceous material.

* * * * *